US006611239B2

(12) United States Patent
Höök

(10) Patent No.: US 6,611,239 B2
(45) Date of Patent: Aug. 26, 2003

(54) GROUP ANTENNA WITH NARROWER SIDE LOBES IN THE HORIZONTAL PLANE

(75) Inventor: Anders Höök, Hindås (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 3 days.

(21) Appl. No.: 09/985,634

(22) Filed: Nov. 5, 2001

(65) Prior Publication Data

US 2002/0057223 A1 May 16, 2002

(30) Foreign Application Priority Data

Nov. 6, 2000 (SE) ..... 0004030

(51) Int. Cl.[7] ..... H01Q 21/20
(52) U.S. Cl. ..... 343/893; 343/757
(58) Field of Search ..... 343/893, 909, 343/754, 756, 700 MS, 803, 853, 757, 824

(56) References Cited

U.S. PATENT DOCUMENTS

| | | | | |
|---|---|---|---|---|
| 4,173,019 A | | 10/1979 | Williams | 343/700 MS |
| 4,532,519 A | | 7/1985 | Rudish et al. | 343/372 |
| 4,746,923 A | * | 5/1988 | Schwartz et al. | 342/117 |
| 4,899,162 A | * | 2/1990 | Bayetto et al. | 343/700 MS |
| 4,907,012 A | | 3/1990 | Trumble | 343/895 |
| 5,434,587 A | * | 7/1995 | Hannan | 343/909 |

FOREIGN PATENT DOCUMENTS

WO 00/46872 A1 8/2000

* cited by examiner

*Primary Examiner*—James Clinger
(74) *Attorney, Agent, or Firm*—Nixon & Vanderhye P.C.

(57) ABSTRACT

The invention relates to an antenna device comprising a group antenna (310) with radiating elements (340–347) in M rows and N columns M, where N<M, which group antenna (310) has a width measurement (b) and a height measurement (h). The group antenna (310) is so arranged in the antenna device that the projection (P) of the group antenna in the sideways direction of the antenna in the horizontal plane (210) exceeds the width measurement (b) of the group antenna, whereby the group antenna is given a narrower main lobe in the horizontal plane (210). A group antenna according to the invention can, in addition, be incorporated in an antenna device (500,700,800) which comprises an additional number of similar group antennas (510–532; 710–720; 810–820), arranged on the antenna device along a surface (730,830) that is circular or a part of a circle, arranged in such a way that the respective projections of the additional group antennas in the sideways direction of the antenna in the horizontal plane also exceed the width measurements of the respective group antennas, whereby the additional group antennas are given narrower main lobes in the horizontal plane.

5 Claims, 8 Drawing Sheets

GROUP ANTENNA WITH NARROWER SIDE LOBES IN THE HORIZONTAL PLANE

TECHNICAL FIELD

The present invention relates to an antenna device with group antennas that are given narrower main lobes in the horizontal plane in a simpler way than what has previously been known.

BACKGROUND ART

Group antennas are a type of antennas that comprise a plurality of radiating elements, usually arranged in M rows and N columns. A common type of group antennas, here called column antennas, have considerably many more rows than columns, which gives a column antenna an antenna beam that is wide in the azimuth (sideways direction) and narrow in the vertical direction.

In connection, for example, with mobile telephony, it is usual to arrange column antennas side by side in a way that gives the required coverage. As a column antenna has a wide antenna beam in the sideways direction, there is a relatively high probability that a large number of sources of interference will be situated within the antenna beam, and the wide antenna beam means that it is difficult to direct the transmission only to the intended subscriber(s).

One way of suppressing sources of interference is to use information from antenna modules with overlapping antenna beams, with associated receivers for the antenna modules. As receivers are expensive, it can be of interest to give the antennas a narrower antenna beam. A known way of obtaining a narrower antenna beam in the sideways direction is to feed several column antennas via a shared feed network, which gives the column antennas a combined antenna beam which is narrow. A disadvantage of this is, however, that the distribution network results in an additional cost, and that the antennas involved must be combined in a way that is difficult.

DISCLOSURE OF INVENTION

There is thus a need to be able to give a column antenna in an antenna device a narrow main lobe in a way that is simpler and cheaper than what has previously been known.

This need is fulfilled by the present invention by providing an antenna device comprising a group antenna with radiating elements in M rows and N columns, where N<M, in other words a column antenna. The group antenna has a width measurement and a height measurement, and is so arranged in the antenna device that the extent of the group antenna in a sideways direction projected in a horizontal plane, exceeds the width measurement of the group antenna, whereby the group antenna is given a narrower main lobe in the horizontal plane.

By the group antenna, the column antenna, being given a narrower main lobe in the horizontal plane, the statistical probability of receiving transmissions from sources of interference in or around the horizontal plane is reduced, and it is easier to direct the transmissions of the group antenna to one or more intended subscribers.

A group antenna arranged according to the invention can be incorporated in an antenna device incorporating a further number of group antennas with N*M radiating elements, where the additional group antennas also have a width measurement and a height measurement, and where the group antennas are arranged on the antenna device along a line that is circular or part of a circle, in such a way that their main lobes cover a required area. The additional group antennas are also arranged in such a way that their respective projections in a sideways direction in the horizontal plane exceed the width measurements of the respective group antennas, whereby the additional group antennas are also given narrower main lobes in the horizontal plane. In this way, an antenna device is created with a number of lobes that are narrow in the horizontal plane, without any shared distribution network needing to be used.

BRIEF DESCRIPTION OF DRAWINGS

In the following, the invention will be described in greater detail in the form of exemplary embodiments and with reference to the attached drawings in which.

MODES FOR CARRYING OUT THE INVENTION

Figure 1:
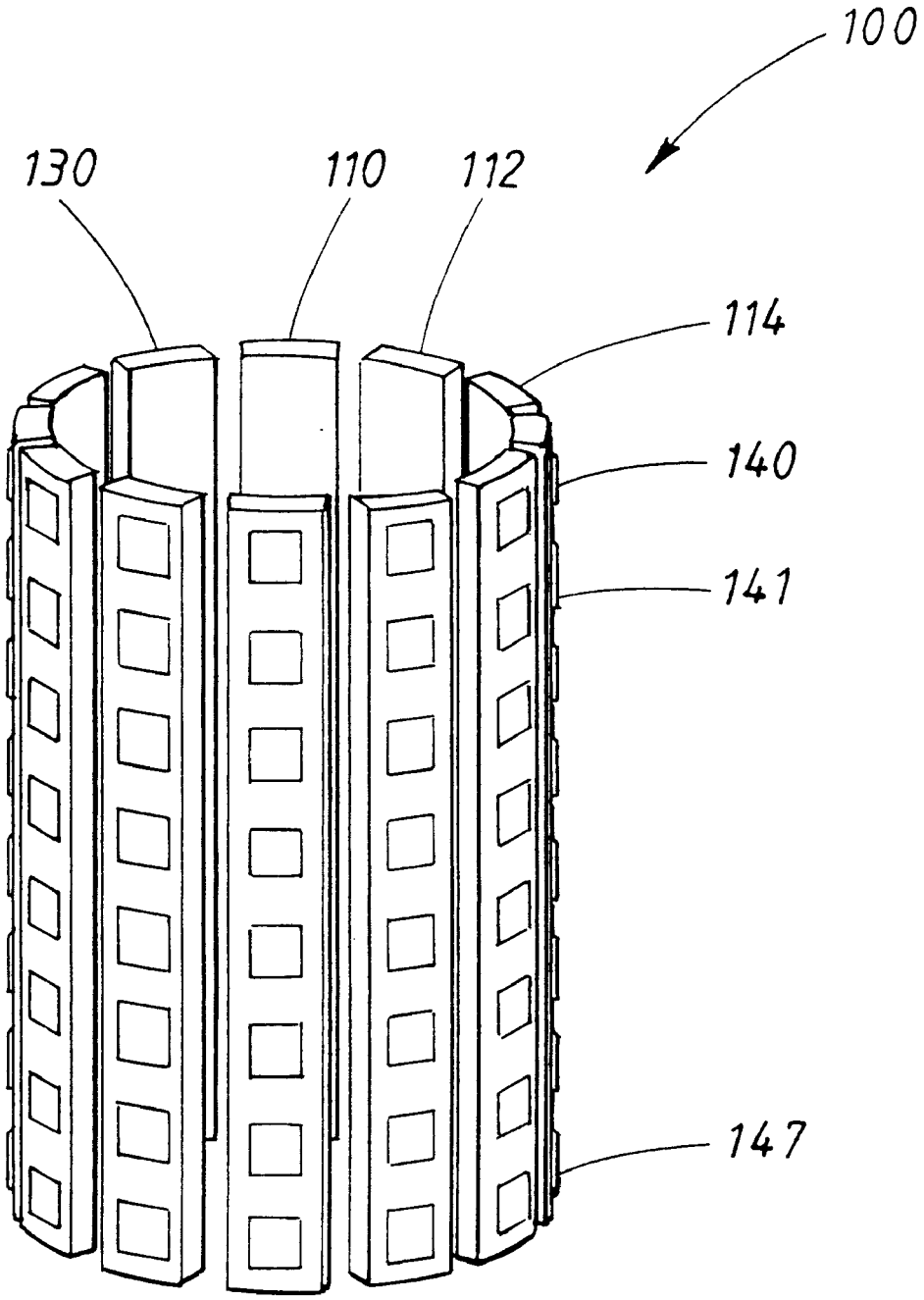
FIG. 1 shows an antenna device with group antennas arranged in the traditional way.

FIG. 1 shows an antenna device 100 incorporating a number of column antennas 110–130, arranged in such a way that the antenna device 100 covers a required area, for example a cell or part of a cell in a mobile telephony system. Each column antenna 110–130 comprises a column with eight radiating elements 140–147 and is, in other words, a column antenna of the type 1*8. By the term column antenna is meant group antennas of the type N*M, where N represents the number of columns, M represents the number of rows and N<M. The column antennas that are shown in this description will throughout be of the type 1*M, which should only be regarded as an example of the number of rows and columns. The number of rows and columns can, of course, be varied in a large number of ways.

Figure 2:
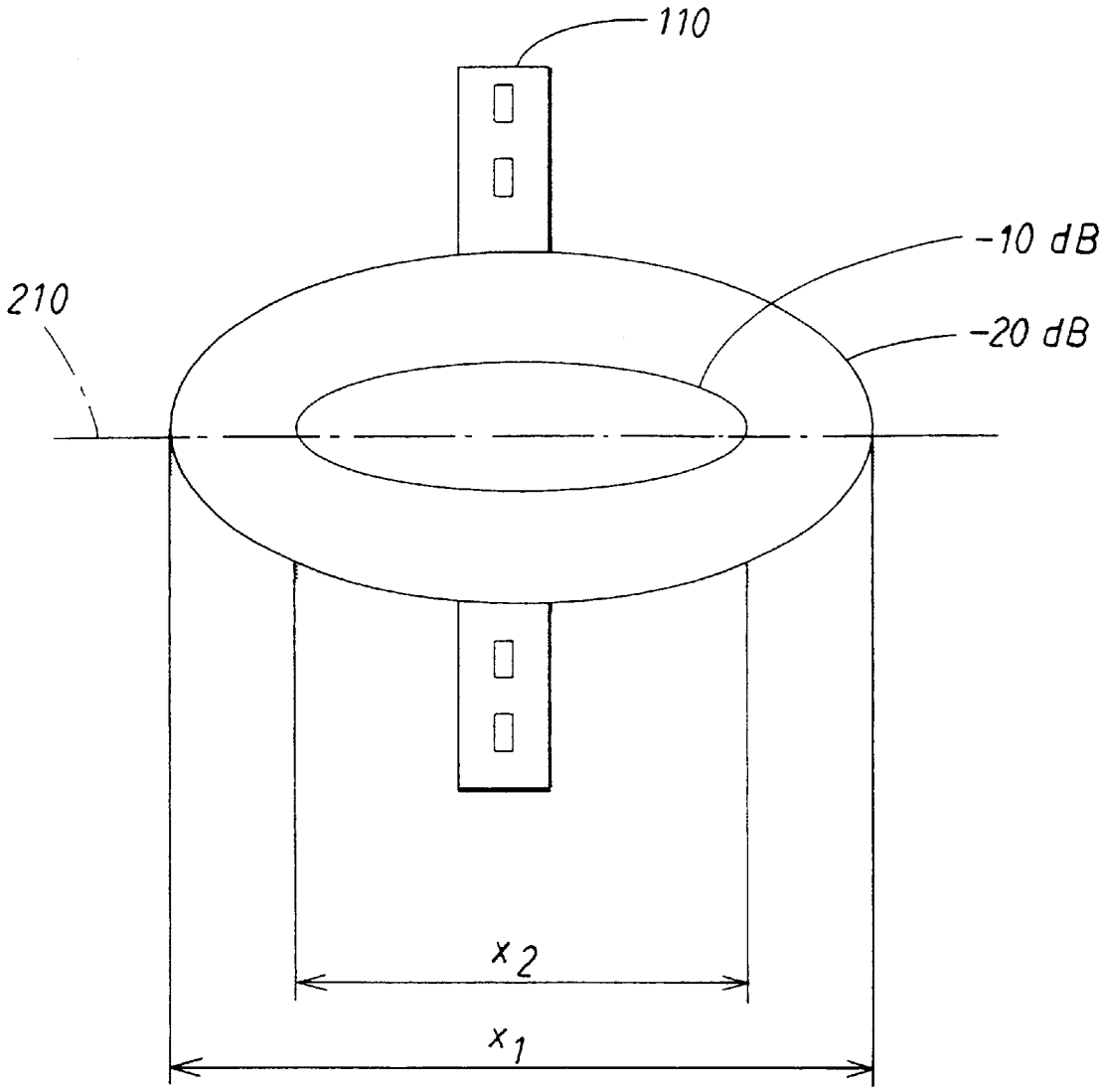
FIG. 2 shows a schematic radiation diagram for a group antenna arranged in the traditional way.

The column antennas in FIG. 1 are arranged according to known technique in the respect that they are arranged vertically and side by side. FIG. 2 shows schematically, viewed from the front, the main lobe for one of the column antennas 110 from FIG. 1. Curves showing where the strength of the main lobe is 10 dB and 20 dB respectively below the maximal strength are drawn in on the figure, and also a line 210 that indicates the horizontal plane. The intersections with the horizontal plane 210 of the curves for the different signal strengths −10 dB and −20 dB respectively of the main lobe are shown by two broken lines $x_1$ (−20 dB) and $x_2$ (−10 dB).

Figure 3:
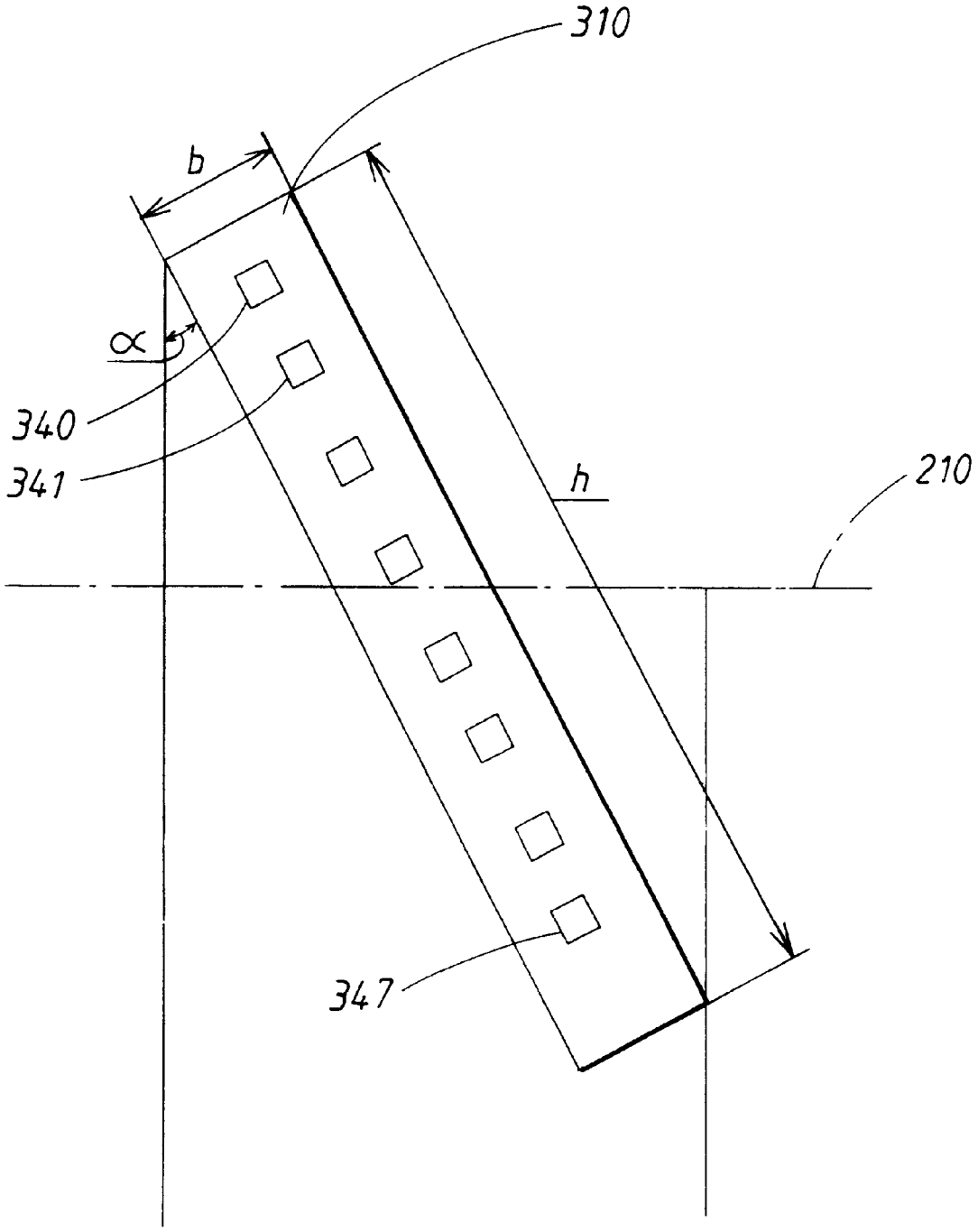
FIG. 3 shows an antenna arrangement with a group antenna arranged according to the invention.

FIG. 3 shows, viewed from the front, a column antenna 310 similar to the column antennas in FIGS. 1 and 2. The column antenna 310 in FIG. 3 also comprises eight radiating elements 340–347 and is of the type 1*8, which also here is only to be regarded as an example of the number of radiating elements and how they are placed on the antenna. The column antenna 310 has a width b and a height h, and the column antenna 310 according to the invention is inclined sideways by an angle α in relation to the vertical, so that the extent of the group antenna in a sideways direction projected in the horizontal plane 210 exceeds its width measurement b. The reason that the column antenna is inclined sideways, and how the inclination can be dimensioned in order to achieve the desired effect, will be explained below.

Figure 4:
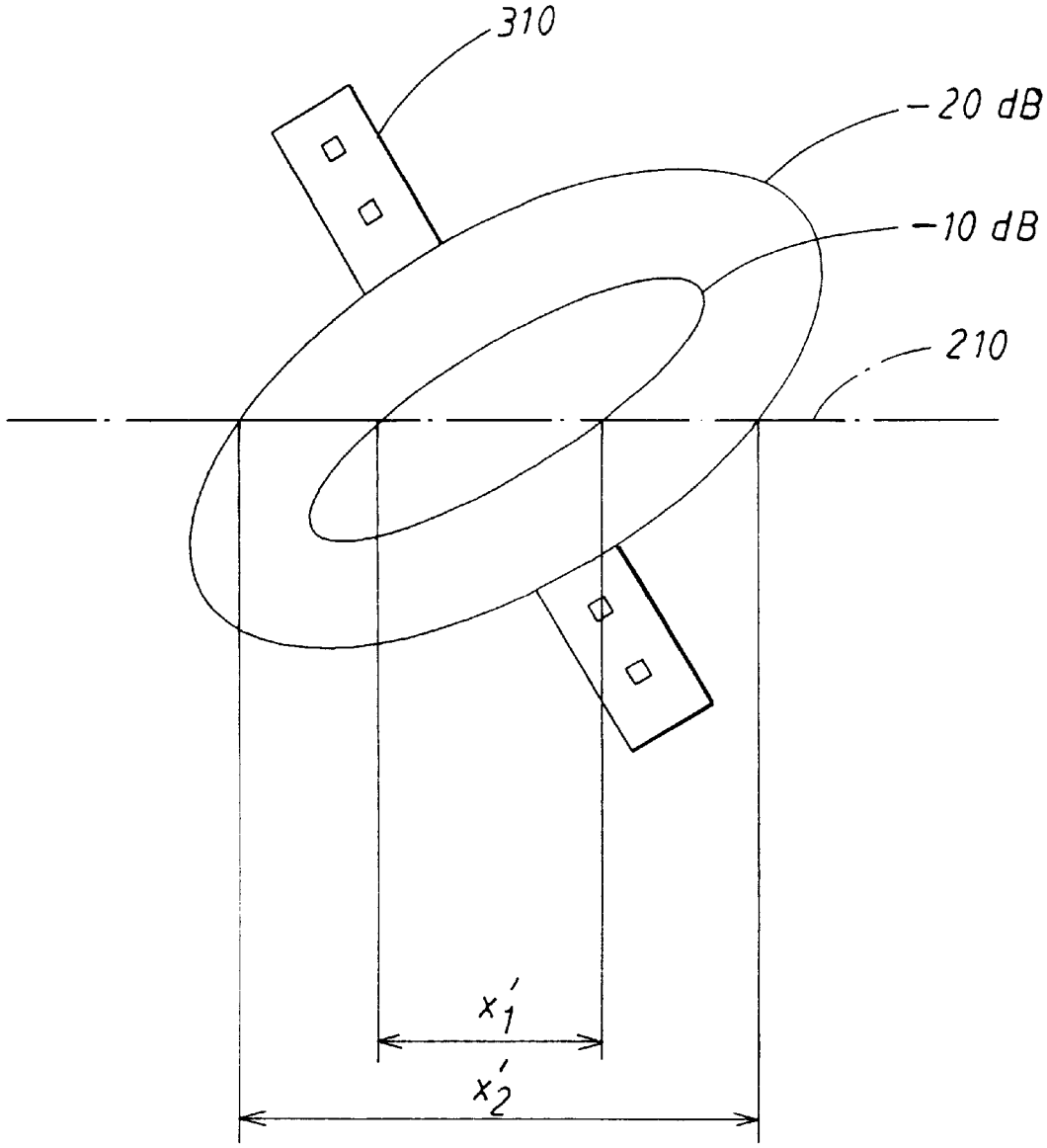
FIG. 4 shows the same type of radiation diagram as FIG. 2, for a group antenna arranged according to the invention.

FIG. 4 shows the column antenna 310 from FIG. 3, the horizontal plane 210 and lines that show where the radiation from the main lobe of the column antenna is 10 dB and 20 dB respectively below the maximal intensity. The intersections with the horizontal plane 210 of the lines for the two different signal strengths in the main lobe, −10 dB and −20 dB respectively, are shown by broken lines $x'_1$ (−20 dB) and $x'_2$ (−10 dB), in the same way as in FIG. 2. The lines $x'_1$ and $x'_2$ show the reason why the column antenna 310 according to the invention is inclined in a sideways direction in relation to the horizontal plane: The lines $x_1'$ and $x_2'$ are shorter than the corresponding lines $x_1$ and $x_2$ in FIG. 2, in other words the intersection of the main lobe with the horizontal plane becomes narrower in a sideways direction for a column antenna according to the invention, which means that the risk of receiving transmissions from sources of interference is reduced and it is easier to direct the transmissions to a particular subscriber or a particular group of subscribers.

A column antenna according to the invention can be used either individually, as an antenna device consisting of one column antenna, or a plurality of column antennas according to the invention can be combined in an antenna device in order to give the antenna device a particular desired cover. Column antennas that are included in such an antenna device will have main lobes that are narrower in the horizontal plane than traditionally arranged column antennas, which means that the distribution network that has been used in known devices in order to obtain narrower main lobes can be eliminated, and the column antennas according to the invention that are incorporated in the antenna device can be fed separately, which results in a simpler and cheaper design.

Figure 5:
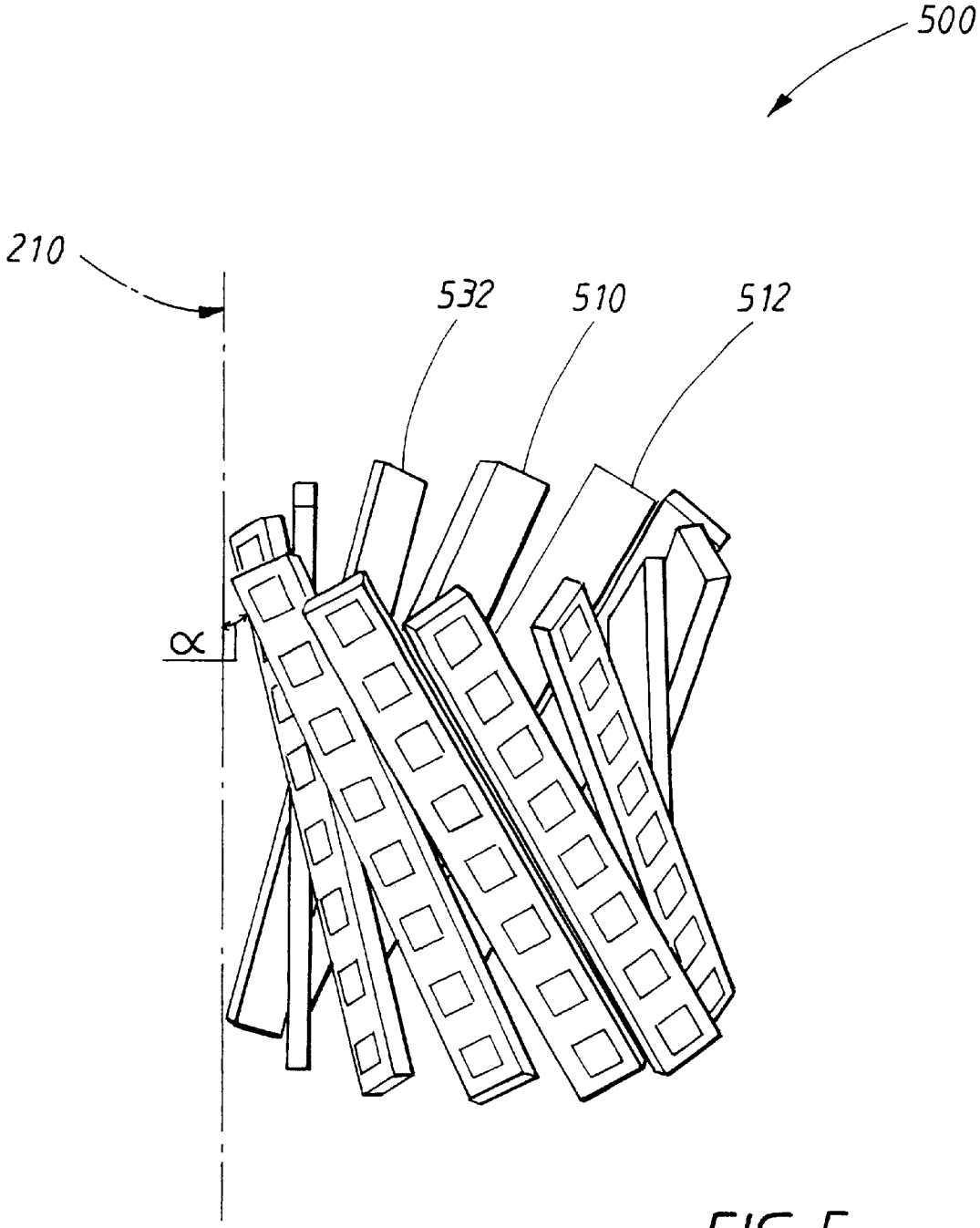
FIG. 5 shows an antenna device with a number of group antennas arranged according to the invention.

FIG. 5 shows an example of an antenna device 500 with column antennas 510–532 according to the invention. The column antennas are arranged in a circle in order to give 360° cover, and are all inclined at an angle α to the vertical line 210. The antenna device 500 in FIG. 5 is to be regarded as only one example of a possible antenna device that can be constructed using column antennas according to the invention. It is, of course, possible to arrange the column antennas in a large number of different ways in order to obtain different types of cover. As an example, it can be mentioned that the column antennas do not need to be arranged so that they cover 360°. They can, of course, be arranged so that they cover any parts of a complete circle, where the line along which they are arranged will be a part of a circle instead of a complete circle. Other geometrical arrangements are also possible, for example column antennas that are arranged side by side in a straight line. In addition, all the column antennas in the device do not need to be inclined sideways by the same angle, which will be clarified by the description below.

Figure 6A:
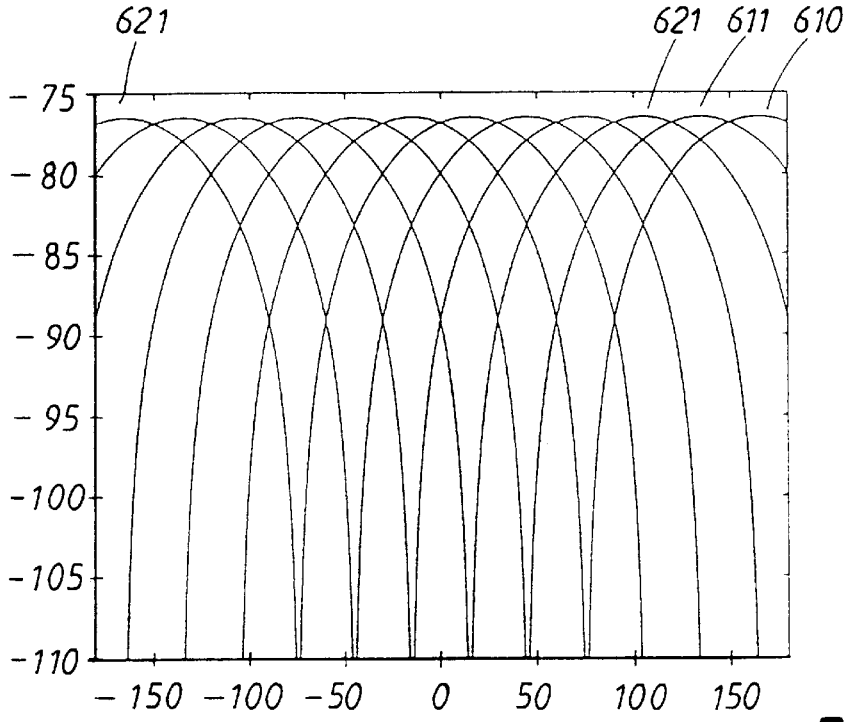
FIGS. 6*a* and 6*b* show antenna diagrams for a traditional antenna device and an antenna device according to the invention respectively.

FIG. 6*a* shows the antenna diagram—signal strength as a function of the sideways angle in the horizontal plane—for an antenna device with column antennas arranged alongside each other in the traditional way. As shown by FIG. 6*a*, there are a number of main lobes 610–621, one for each column antenna, which main lobes are relatively wide in a sideways direction, with the disadvantages that this entails that are described above.

Figure 6B:
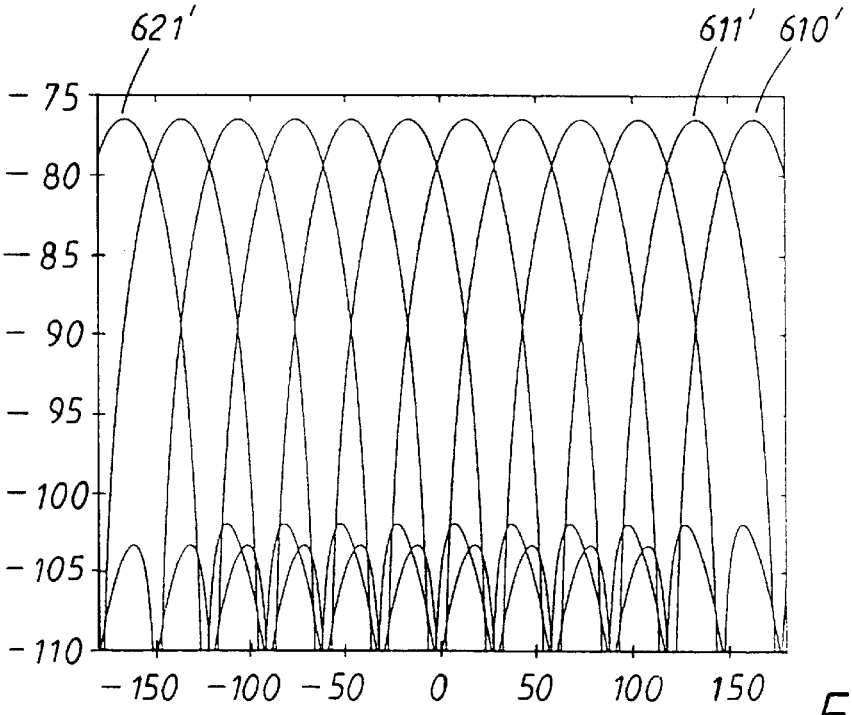

FIG. 6*b* shows the antenna diagram for an antenna device where the incorporated column antennas have been arranged according to the invention. As shown in FIG. 6*b*, the main lobes 610'–621' in this antenna device have a narrower intersection with the horizontal plane than those in FIG. 6*a*, which is what is required. The angle α by which the column antennas have been inclined in a sideways direction—in other words the angle to the vertical—is selected so that the different main lobes intersect each other at their so-called 3 dB points, which is only to be regarded as an example. The angle of inclination can be selected so that it gives the required overlapping between the main lobes and does not need to be the same for all the column antennas in the antenna device.

Figure 7:
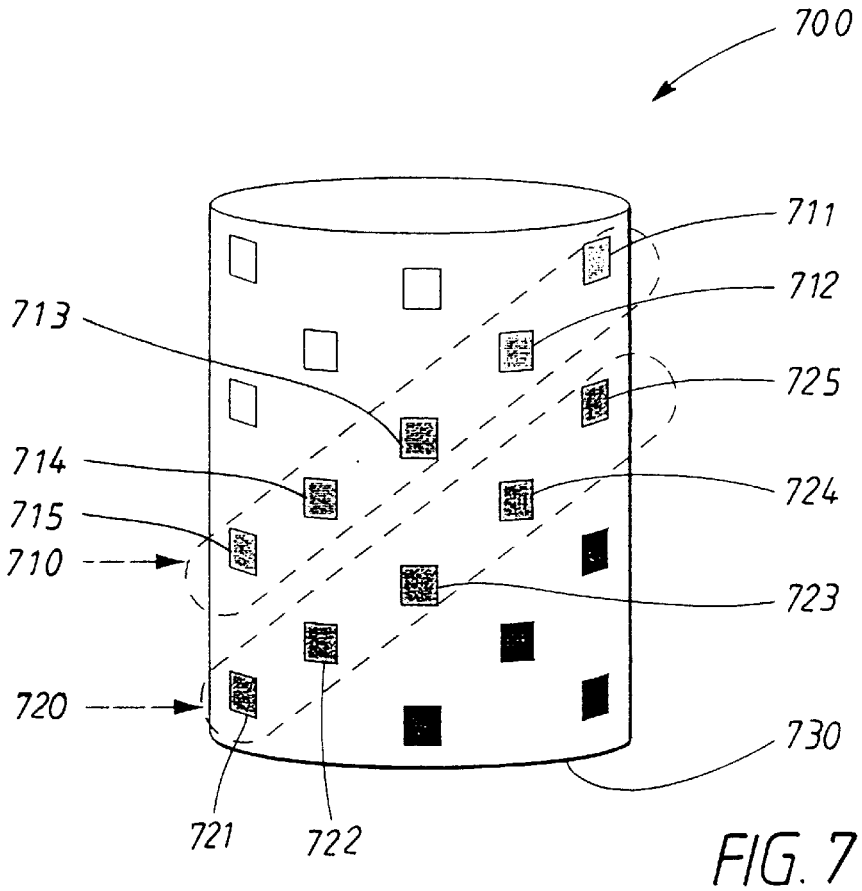
FIGS. 7 and 8 show antenna devices with group antennas arranged in alternative ways according to the invention.

FIG. 7 shows an alternative antenna device 700 according to the invention. In this variant of the invention, a number of column antennas 710, 720 are arranged on the antenna device on a circular surface 730 in such a way that the column antennas follow the circular surface 730 and are hence themselves curved. The basic idea of the invention is, however, retained, as the column antennas are inclined in a sideways direction so that their respective projections in the horizontal plane exceed their width measurements. This type of antenna device takes up less space than, for example, the one in FIG. 5, and provides a single device to attach to other structures.

Figure 8:
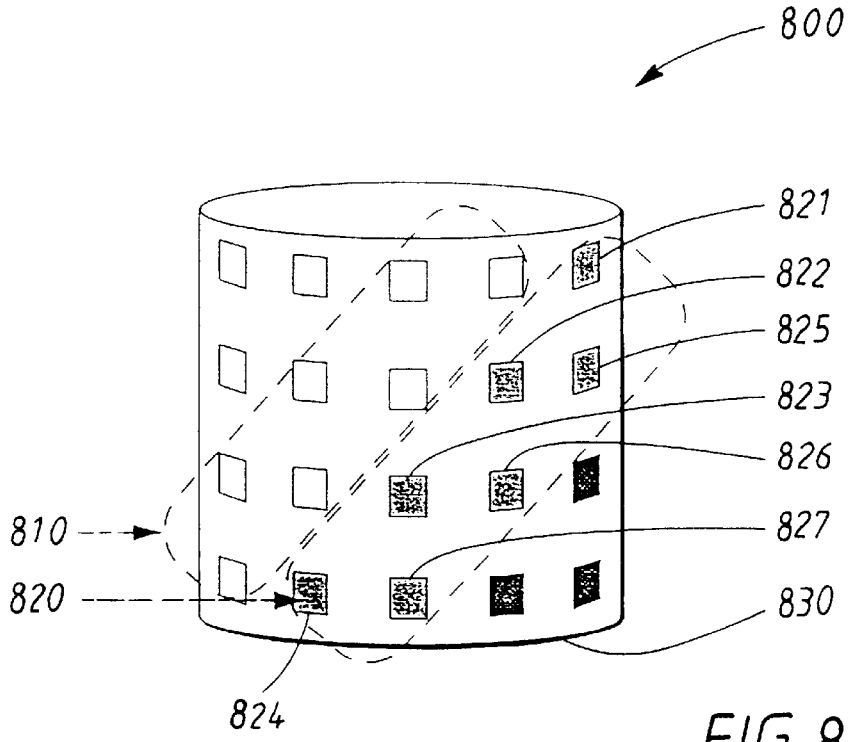

FIG. 8 shows an antenna device 800 according to another variant of the invention. As in the embodiment in FIG. 7, the antenna device 800 comprises a number of column antennas 810, 820 which are arranged on a curved surface 830 in such a way that they follow the surface, in other words the column antennas are also curved, and in accordance with the invention they are inclined in a sideways direction so that their respective projections in the horizontal plane exceed their width measurements. What distinguishes the embodiment in FIG. 8 from the one in FIG. 7 is that the column antennas 810, 820 each comprise two columns of radiating elements 821–830 and also the placing of the radiating elements.

Figure 9:
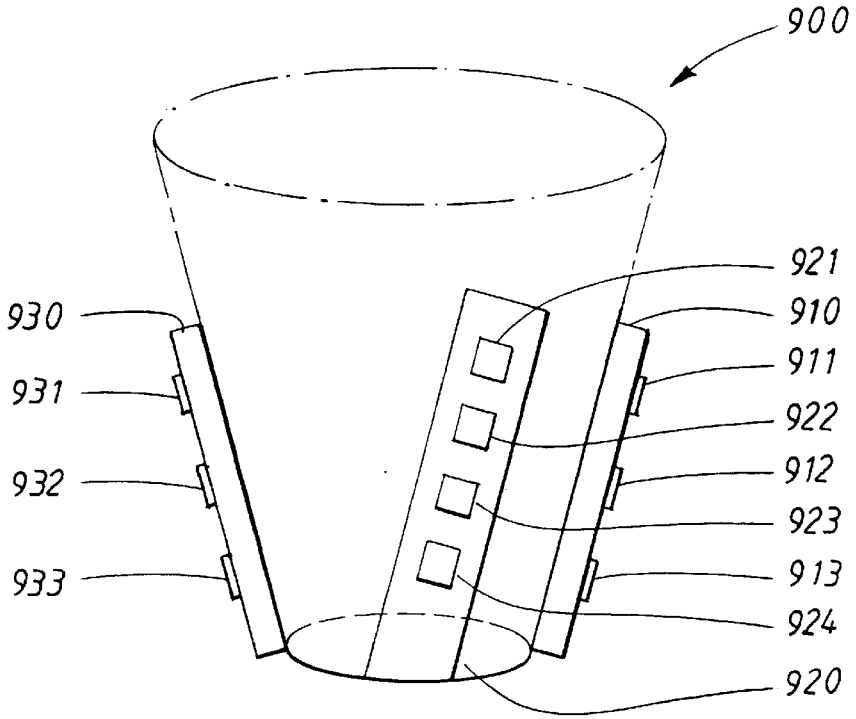
FIGS. 9 and 10 show antenna devices with group antennas arranged in additional alternative ways according to the invention.

In an antenna device with column antennas arranged according to the invention, there can be a desire to direct the transmitted energy in such a way that the range is limited and the energy is directed more towards the recipients for whom it is intended, for example the subscribers in a cell in a mobile telephony system. FIG. 9 shows a further possible embodiment 900 of the invention that fulfils this requirement: Instead of arranging column antennas according to the invention making contact with a right cylinder that is perpendicular to the horizontal plane, which is shown in FIG. 5, the column antennas 910, 920, 930 can be arranged according to the invention along, for example, an imaginary conical surface, which means that the column antennas 910, 920, 930 will be inclined in a sideways direction according to the invention and will also be inclined "forwards", which limits the range and better directs the lobes towards the intended area of cover. For the sake of clarity, radiating elements 911–913, 922–924 and 931–933 have been drawn in on the column antennas 910, 920, 930 in FIG. 5. The conical surface is only one example of a possible geometric shape that fulfils the requirement for a surface that means that the column antennas are inclined "outwards". There are, of course, a large number of other surfaces with the same property.

Figure 10:
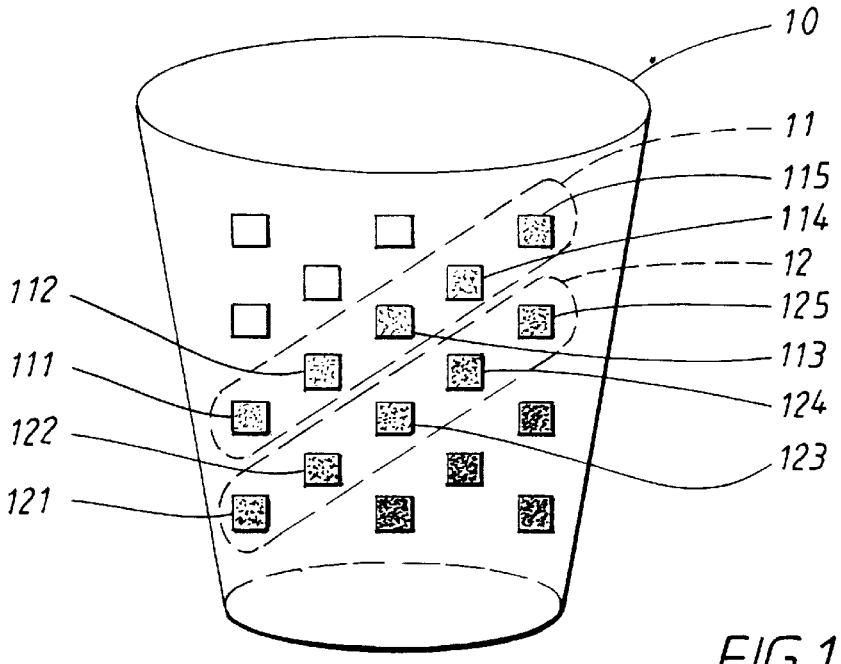

FIG. 10 shows an embodiment 10 that in principle corresponds to the one in FIG. 7, but with the difference that the radiating elements are arranged on and around a conical surface, which combines the advantages of the embodiments in FIG. 7 and FIG. 9. A number of radiating elements are arranged on a conical surface 10, and combined into antennas that also are inclined in a sideways direction. FIG. 10 shows how column antennas 11 and 12 according to the invention can be made up of a number of radiating elements, 111–115 and 121–125 respectively.

The invention is not restricted to the embodiments described above, but can be varied freely within the scope of the following claims. For example, the angles at which the column antennas are inclined according to the invention can, in principle, be selected as required, and all the column antennas do not need to be inclined at the same angle. Nor does the number of radiating elements need to be the same in all the column antennas in an antenna device with column antennas according to the invention. In addition, the type of radiating element that is used can be selected from a large number of types of such elements, for example patches and slots. In the drawings, the radiating elements have been shown throughout as rectangular patches, one side of which has a direction that either has followed the angle of inclination $\alpha$ of the group antenna or has coincided with the vertical. The direction of the radiating elements in relation to the vertical affects the polarization of the signal, for which reason it should be pointed out that radiating elements in a group antenna according to the invention can, in principle, be given any inclination in relation to the vertical line and/or the group antenna within the scope of the idea.

What is claimed is:

1. An antenna device comprising:

a group antenna with radiating elements in M rows and N columns, where N<M, said group antenna having a width (b) and a height (h), said width (b) and height (h) being perpendicular to one another, wherein the group antenna is arranged in the antenna device in a tilted or slanted manner, with respect to vertical, so that the lateral extent of the group antenna sideways, projected in a horizontal plane (210), exceeds the width (b) of the group antenna, so that the group antenna has a narrower main lobe in the horizontal plane than would a corresponding antenna arranged vertically.

2. An antenna device according to claim 1, further comprising a number of group antennas with N*M radiating elements, each with a width (b) and a height (h), arranged on the antenna device around a surface that is circular or part of a circle, so that respective projections of the additional group antennas in the sideways direction of the antenna in the horizontal plane exceed the width measurements of the respective group antennas, whereby the additional group antennas are given narrower main lobes in the horizontal plane.

3. An antenna device according to claim 2, in which the group antennas (710,720; 810,820) incorporated in the antenna device are curved on the surface (730,830) that is circular or part of a circle.

4. An antenna device according to claim 1, in which a number of the group antennas comprise radiating elements of the patch type.

5. An antenna device according to claim 1, in which a number of the group antennas comprise radiating elements of the slot type.

* * * * *